United States Patent [19]

Hanagata

[11] Patent Number: 4,658,569

[45] Date of Patent: Apr. 21, 1987

[54] PACKAGING APPARATUS

[75] Inventor: Toshiyuki Hanagata, Toyama, Japan

[73] Assignee: Hanagata Press Industry Co., Ltd., Toyama, Japan

[21] Appl. No.: 840,295

[22] Filed: Mar. 14, 1986

[30] Foreign Application Priority Data

Dec. 5, 1985 [JP] Japan ..... 60-273975

[51] Int. Cl.[4] ..... B65B 9/06; B65B 41/10

[52] U.S. Cl. ..... 53/550; 53/389

[58] Field of Search ..... 53/550, 551, 552, 553, 53/389

[56] References Cited

U.S. PATENT DOCUMENTS

| | | | |
|---|---|---|---|
| 4,035,983 | 7/1977 | Shanklin et al. . | |
| 4,073,116 | 2/1978 | Glover | 53/550 |
| 4,118,913 | 10/1978 | Putnam, Jr. et al. | 53/551 |
| 4,141,196 | 2/1979 | Blanding | 53/550 |
| 4,185,443 | 1/1980 | Budzyn . | |
| 4,219,988 | 9/1980 | Shanklin et al. . | |
| 4,587,794 | 5/1986 | Kopp | 53/550 |
| 4,589,247 | 5/1986 | Tsuruta et al. | 53/550 |

FOREIGN PATENT DOCUMENTS 46-2274 11/1972 Japan .

*Primary Examiner*—Horace M. Culver

*Attorney, Agent, or Firm*—Flynn, Thiel, Boutell & Tanis

[57] ABSTRACT

A packaging apparatus for packaging articles in a weldable and heat-contractive plastic film, comprising: a sealing device for welding and heat-cutting the plastic film to provide a package sealed at the opposite ends, a forming device disposed before the sealing device and having a pair of deflecting members for spreading the plastic film a transfer belt conveyor extended through the forming device to convey an article through the forming device to the front end of the opening of the spreaded plastic film, and a driving roller and a pressure roller disposed between the front end of the transfer belt conveyor and the sealing device so as to nip the plastic film therebetween to advance the plastic film through the sealing device. The side edges of the plastic film is pulled out by a necessary length for every sealing cycle of the sealing device.

6 Claims, 9 Drawing Figures

PACKAGING APPARATUS

BACKGROUND OF THE INVENTION

1. Field of the Invention

The present invention relates to a packaging apparatus and, more specifically, to a packaging apparatus for packaging articles with a weldable and heat-contractive film.

2. Description of the Prior Art

Generally a conventional packagaing apparatus for packaging articles in a weldable and heat-contractive film comprises an article feeding device, a film feeding device, a forming device for folding a weldable and heat-contractive film in a tubular shape, a seling device for welding the seam of a package and separating the package from the film by heat-cutting, and a heat tunnel for making the packaging film heat-contract.

In packaging articles on a conventional packaging apparatus, the film is folded in a tubular shape continuously by folding the opposite side edges downward and then inward, while articles are inserted one by one into an opening formed by the film folded in a tubular shape. In folding the film, the side edges of the film are made to overlap each other to form a seam along one side edge of the package of on the underside of the package. In finishing the package, the seam is welded or the unfinished package is subjected to heat-contraction without welding the seam. Since the sealed package has an undersirable apperarance when the package has a seam along the side edge thereof, it is desirable to form a seam on the underside of the package particularly in packaging an article which attaches importance to the appearance and morphology of the package.

On a packaging apparatus capable of packaging articles in packages each having a seam on the underside thereof, a flat sheet fed to the forming device is formed in a tubular shape by folding the opposite side edges downward and then inward by the forming device, then the opposite side edges are guided inward, namely, toward each other, with right and left guide rollers to form and hold the seam, and then the seam is sealed, when necessary, with a sealing device. In packaging articles on this packaging apparatus, articles are fed to the packaging station sequentially at regular intervals by means of a belt provided with fingers arranged at regular intervals; the package is delivered from the packaging station to a continuously rotating conveyor belt disposed next to the packaging station; and the film is pulled out from the film feeding device by the advancement of the package on the conveyor belt. This manner of feeding the film is achieved by known methods and apparatus, in which the package is held at a fixed position on the moving conveyor belt by its own dead weight, with a pressure belt applied thereto or by vacuum produced by a vacuum mechanism so that the film is fed as the package is conveyed by the conveyor belt.

However, since a packaging apparatus of this type folds the film in a tubular shape by a forming device, inserts an article into an opening formed by folded film, and guides the opposite side edges of the folded film inward to make the opposite side edges overlap each other to form a seam and holds the seam with the right and left guide rollers, which deteriorates the appearance of the package and causes faulty sealing of the package due to the deviation of the seam from the sealing head.

Furthermore, in packaging articles on such a conventional packaging apparatus, since a package containing an article is delivered from the packaging station to the continuously rotating conveyor belt disposed next to the packaging station and the film is pulled out continuously from the film feeding device by the advancement of the package, an imply package is formed when the article feeding conveyor fails to feed the next article to the packaging station, and thereby the corresponding amount of the film is wasted. Further, since the sealing device is actuated at regular intervals, articles need to be fed at regular intervals and it is impossible to package articles satisfactorily when the articles are irregular in size.

Still further, since the film is pulled out from the film feeding device by the advancement of the package held at a fixed position on the conveyor belt by its own dead weight, a light article is unable to pull out the film smoothly. In order to solve such a problems, an apparatus which holds the package on the conveyor belt with a pressure belt have been proposed. However, those apparatus are complicated in construction and expensive.

SUMMARY OF THE INVENTION

The applicant of the present invention invented, through a zealous study to solve those problems of the conventional packaging apparatus, a packaging apparatus capable of feeding a film properly according to article feeding operation even if articles are fed irregularly, forming a seam accurately on the underside of the package and packaging articles satisfactorily even when the articles are irregular in size, and filed a patent application: Japanese Patent Application No. 59-198994 on Sept. 21, 1984. This previous packaging apparatus is illustrated in FIG. 1. In packaging articles on the previous packaging apparatus, an article 2 passed through a former 4 is delivered to a sealing device 9 by the agency of its own dead weight, the rotative force of a driving roller 5 and a pressure applied to the article 2 by a free roller 12, and thereby a film is pulled out as the article advances.

Further study has been made to improve the film feeding mechanism of the precious packaging apparatus to make the present invention.

Accordingly, it is an object of the present invention to provide a packaging apparatus simple in construction and capable of satisfactorily packaging articles.

The object of the present invention is achieved by a packaging apparatus comprising: a sealing device for welding and heat-cutting a plastic film widthwise; a forming device disposed before the sealing device (right-hand side as viewed in FIG. 2) and having a pair of deflecting members disposed opposite to each other with a longitudinal space therebetween; a guide bar disposed above the forming device with the longitudinal axis thereof in parallel to the longitudinal center axis of the forming device and with the contact line, where the plastic film leaves the guide bar, in alignment with the longitudimal center axis of the foming device; a cantilever transfer belt conveyor for transferring articles from a feed belt conveyor to the sealing device, supported at the rear end so as to extend through the space between the deflecting members of the forming device; a driving roller disposed between the front end of the transfer belt conveyor (left-hand end as viewed in FIG. 2) and the sealing device, to drive the plastic film from below; and a pressure roller disposed above the driving roller to press the plastic film against the driving roller, wherein the lower portions of the deflecting members are bent inward to form seaming flanges, the rear ends of the deflecting members are cut diagonally from the upper portions to the inner edges of the seaming flanges to form slopes declining toward the front, respectively, so that the plastic film folded in half is turned inside out along the respective outer surfaces of the deflecting members, and the saling device is actuated upon the passage of an article through the sealing device.

The above and other objects, features and advantages of the present invention will become more apparent from the following description of a preferred embodiment thereof taken in conjunction with the accompanying drawings.

BRIEF DESCRIPTION OF THE DRAWINGS

FIGS. 2 to 9 inclusive are views illustrating packaging apparatus, in a preferred embodiment, according to the present invention in which:

FIG. 2 is a schematic illustration showing the general configuration of the packaging apparatus;

FIG. 3 is a plan view of unfolded deflecting members of a forming device;

FIG. 4 is a fragmentary perspective view of the forming device showing a manner of turning a plastic film folded in half inside out to form an opening;

FIG. 5 is a bottom view of the principal portion of the packaging apparatus;

FIGS. 6, 7 and 8 are sectional views taken on lines A—A, B—B and C—C in FIG. 5 respectively; and FIG. 9 is a perspective view of the principal portion of a film feeding device.

DESCRIPTION OF THE PREFERRED EMBODIMENT

A packaging apparatus, in a preferred embodiment, according to the present invention will be described hereinafter with reference to FIGS. 2 to 9.

Figure 1:
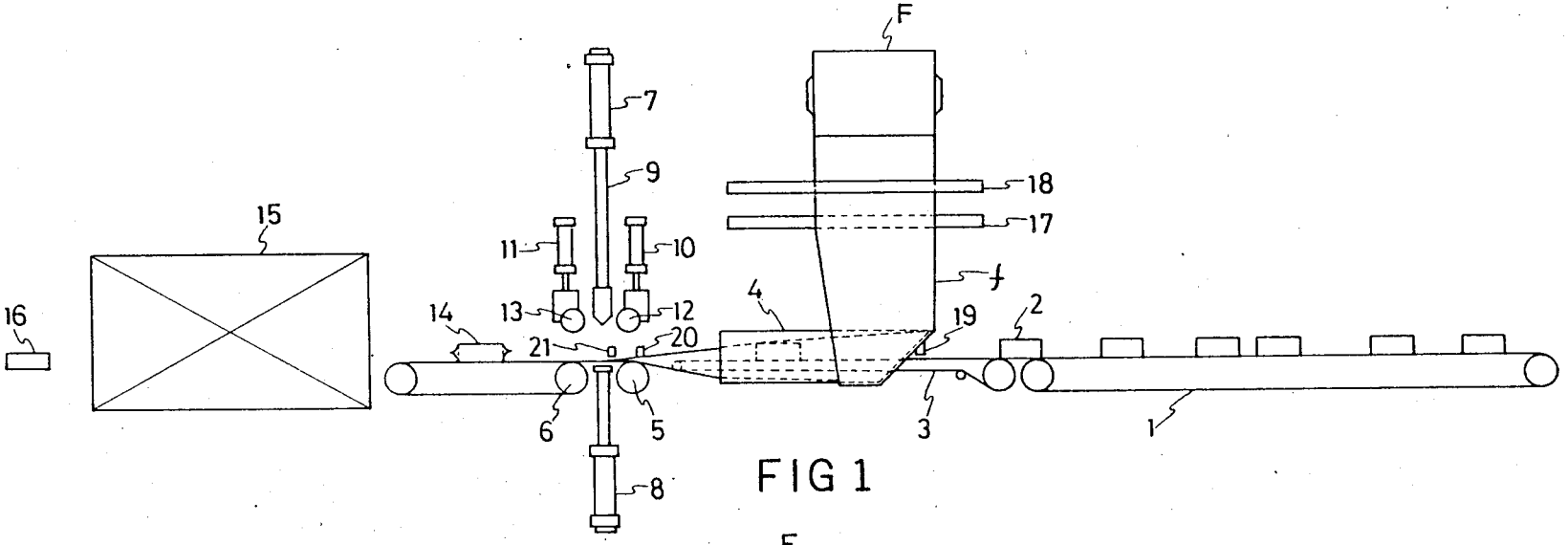
FIG. 1 is a schematic illutration of a packaging apparatus embodying the prior invention disclosed in Japanese Patent Application No. 59-198994.
Figure 2:
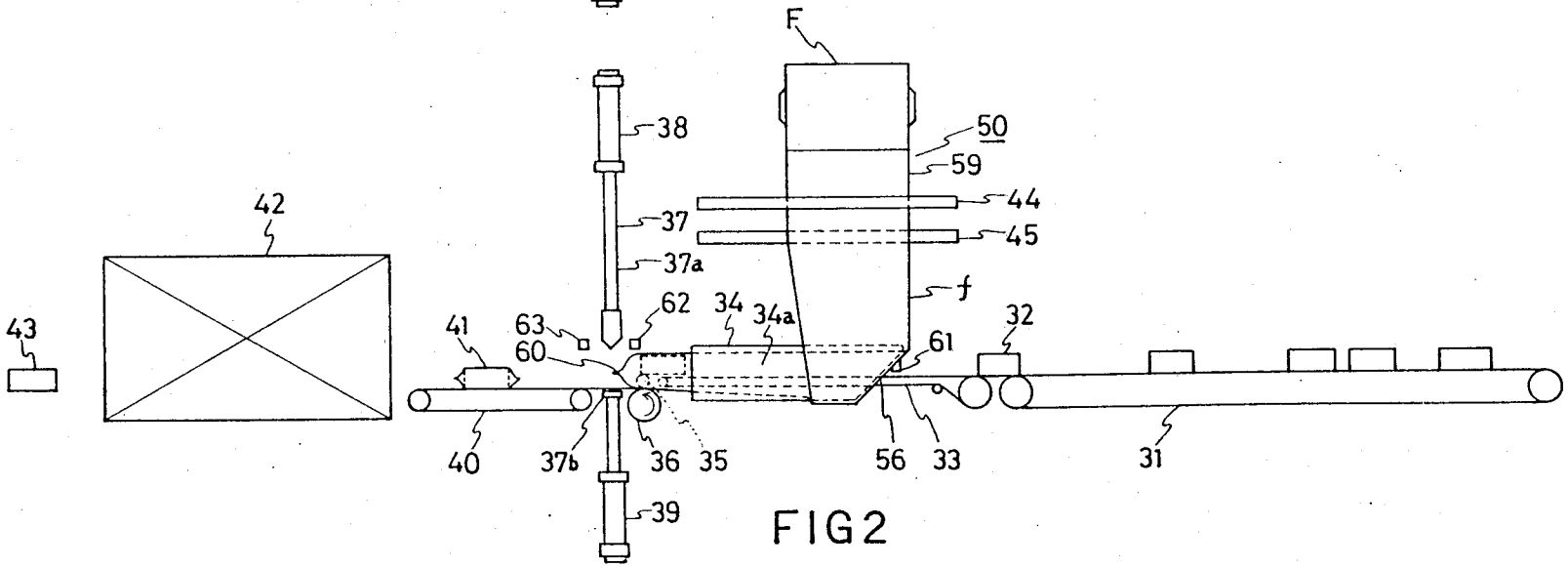

Referring to FIG. 2, there are shown an article feeding belt conveyor 31 for feeding articles 32 to the packaging apparatus, a tranfer belt conveyor 33 for transferring articles 32 from the article feeding belt conveyor 31 to a sealing device 37, a forming device 34 disposed before the sealing device 37, a film feeding device 50 disposed above the forming device 34, and a delivery belt conveyor 40 for conveying packaged articles from the sealing device 37 to a heat tunnel 42. The transfer belt conveyor 33 is extended through the forming device 34 to convey the articles 32 through the forming device 34.

Figure 3:
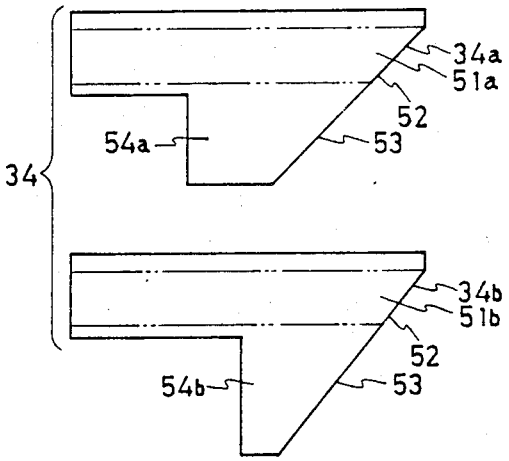
Figure 5:
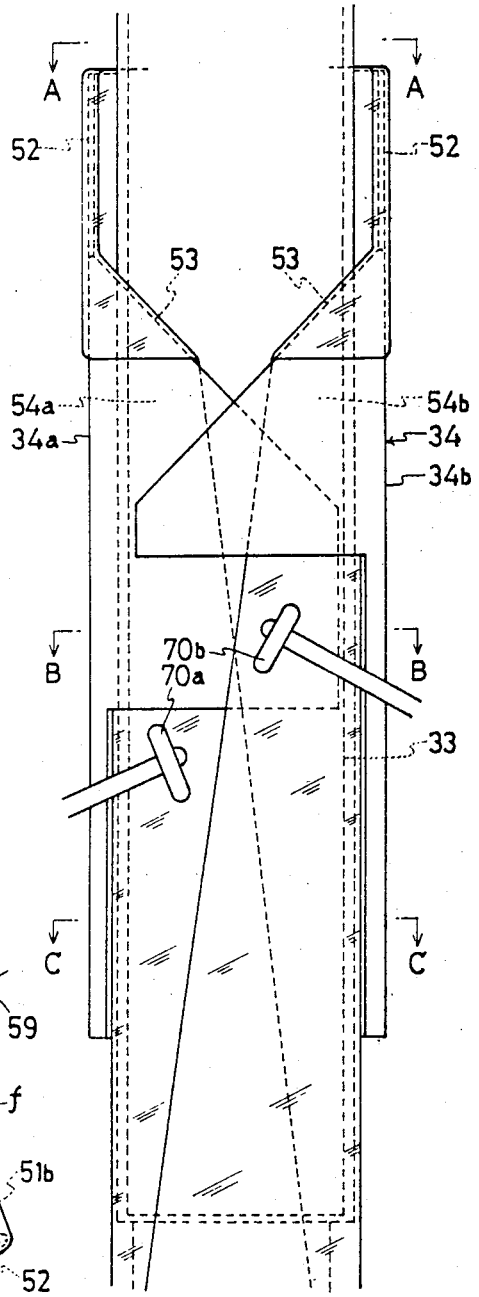

The forming device 34 comprises a pair of deflecting members 34*a* and 34*b* which are disposed on opposite sides of the transfer belt conveyor 33, respectively. The deflecting members 34*a* and 34*b* can be moved toward or away from each other to adjust the distance between the respective side walls 51*a* and 51*b* thereof. The deflecting members 34*a* and 34*b* are formed by bending steel plates cut in a predetermined shape as shown in FIG. 3 along alternate long and two short dashed lines. The respective upper ends of the steel plates are bent inward to form upper flanges 55*a* and 55*b* and side walls 51*a* and 51*b*, while the lower ends of the side walls 51*a* and 51*b* are bent inward to form seaming flanges 54*a* and 54*b*. The deflecting members 34*a* and 34*b* are disposed opposite to each other with the seaming flanges 54*a* and 54*b* overlapping each other. The rear ends (right-hand ends as viewed in FIG. 4) of the deflecting members 34*a* and 34*b* are cut diagonally to form slopes 52 and 53 declining at an inclination of about 45 from the upper edges of the side walls 51*a* and 51*b* to the inner edges of the seaming flanges 54*a* and 54*b*. The deflecting members 34*a* and 34*b* are disposed so as to define a space having a rectangular cylinder. The seaming flanges 54*a* and 54*b* need not be of any particular shape, provided that the slopes 52 and 53 are formed in the rear ends thereof. The seaming flanges 54*a* and 54*b* are different from each other in longitudinal size so that guide rollers can be brought into contact with the lower surfaces of both the seaming flanges 54*a* and 54*b*, respectively. It is also possible to form the seaming flanges 54*a* and 54*b* in the same shape and to provide plates, not shown, with which the guide rollers 70*a* and 70*b* for guiding a film f are brought into contact, respectively.

The transfer belt conveyor 33 disposed next to the article feeding belt conveyor 31 is operated at a conveying speed considerably higher than that of the article feeding belt conveyor 31. Since the transfer belt conveyor 33 is extended through the forming device 34 and also through an opening formed by opening the film f by the forming device 34, the transfer belt conveyor 33 is supported in a cantilever fashion at a portion thereof near the entrance of the forming device 34 and is extended into the forming device 34.

Figure 4:
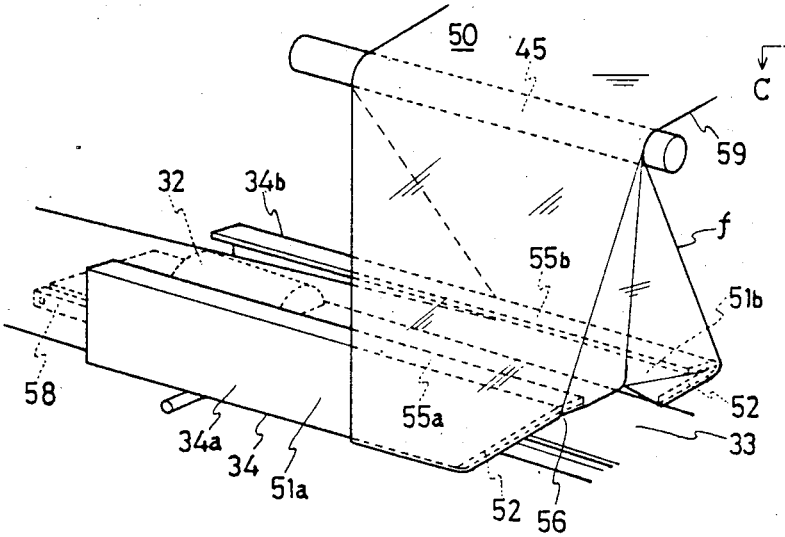
Figure 6:
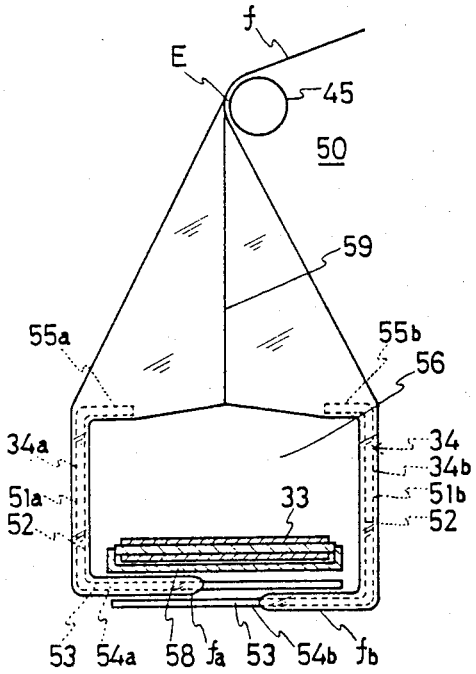
Figure 7:
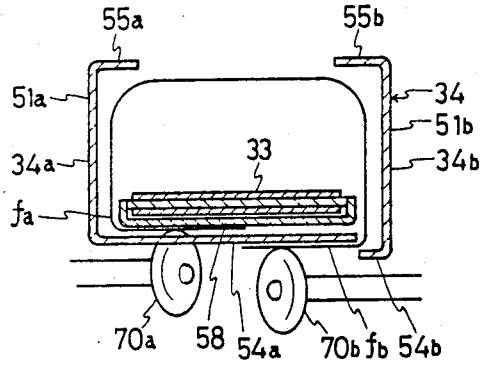
Figure 8:
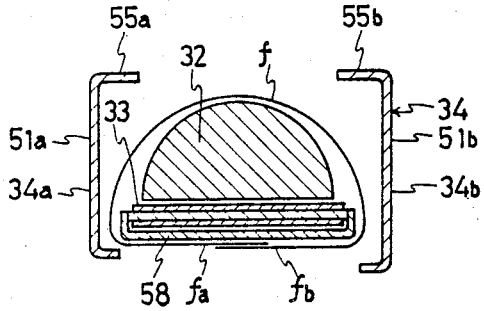

The film feeding device 50 feeds the film f folded in half from a roll F of film via several guide bars 44 and 45 disposed with their longitudinal axes in parallel to the longitudinal direction of the transfer belt conveyor 33 to the forming device 34. As illustrated in FIG. 4, the last guide bar 45 disposed at the lowermost position is disposed with the contact line E where the film f leaves the lawst guide bar 45 in alignment with the longitudinal center axis of the forming device 34.

The sealing device 37 is provided with an I-type sealing head 37*a*, a pressing block 37*b* disposed below the sealing head 37*a* so as to receive the sealing head 37*a* thereon, and hydraulic or pneumatic cylinders 38 and 39 for operating the sealing head 37*a* and the pressing block 37*b*. The film f is pressed between the sealing head 37*a* and the pressing block 37*b* with the hydraulic or pneumatic cylinders 38 and 39 to heat-cut the film f with the central blade of the sealing head 37*a* and to weld the layers of the film f with heat bars provided on the opposite sides of the central blade.

Figure 9:
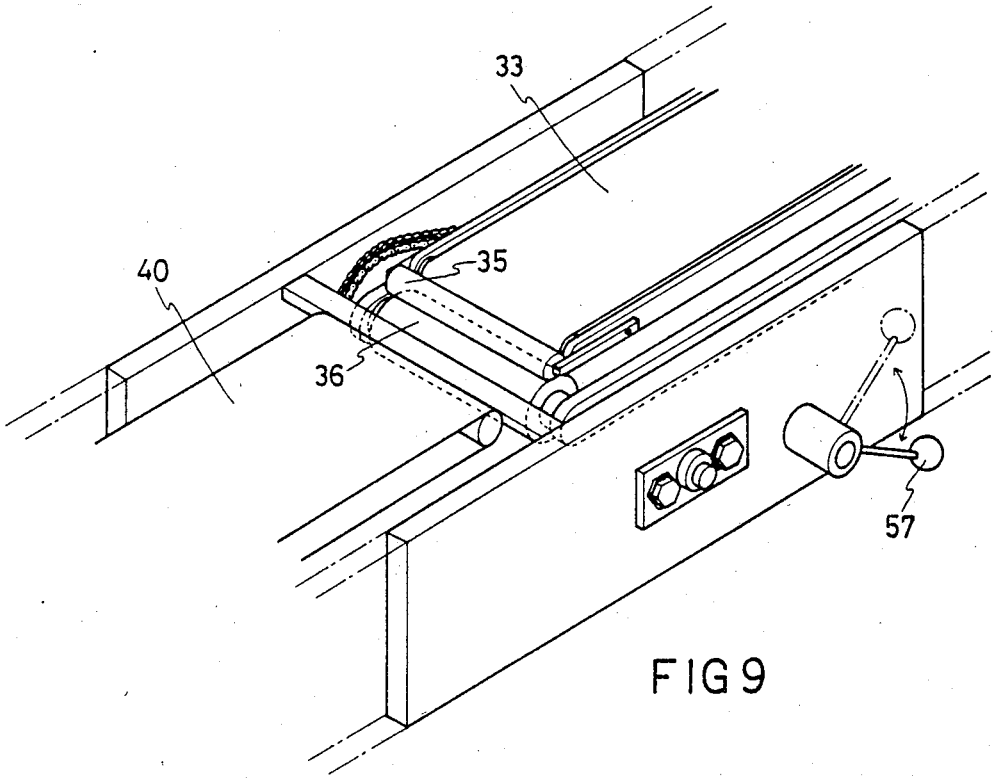

A driving roller 36 is disposed between the transfer c belt conveyor 33 and the sealing device 37, while a pressure roller 35 is disposed above the driving roller 36 so as to pinch the film f between the driving roller 36 and the pressure roller 35. The film f is pulled out from the roll F of film by the agency of the rotative driving force of the driving roller 36 and the pressure applied to the film f with the pressure roller 35. The pressure to be applied to the film f with the pressure roller 35 is adjusted by means of a lever 57 (FIG. 9).

In operation, the roll F of film is mounted on the film feeding device 50 with the fold 59 of the folded film f on the rear side with respect to the direction of advancement of the articles 32, then the side edges of the folded film f folded in half are opened so as to cover the front end of the forming device 34, and then the fold 59 is pushed through the entrance 56 of the forming device 34. The side edges fa and fb of the film f is pulled in below the insulating plate 58 of the transfer belt conveyor 33 and along the upper surfaces of the seaming flanges 54*a* and 54*b*, respectively. Then, the front end of the film f is pulled through the front end of the forming device 34 and the sealing device 37.

When the film f is thus arranged, since the contact line E of the guide bar 45 is aligned with the longitudinal center line of the forming device 34, the fold 59 of the film f corresponds to the perpendicular bisector of an isosceles triangle and is aligned with the longitudinal center line of the forming device 34. The film f is folded stably along the slopes 52 and 53 of the deflecting members 34*a* and 34*b*, so that the film f is spreaded stably in the shape of an isosceles triangle, and thereby the film f is retained at a correct position with respect to the forming device 34.

The spreading shape of the film f is dependent on the position of the contact line E of the guide bar 45 with respect to the longitudinal center line of the forming device 34; when the contact line E is dislocated from the position corresponding to the longitudinal center line of the forming device 34, the spreading shape of the film f changes accordingly, which is desirable in packaging some kinds of articles.

After the film f has been spreaded in the manner as described hereinbefore, the packaging apparatus is started. Then, the article 32 is transferred from the article feeding belt conveyor 31 to the transfer belt conveyor 33, then the article 32 is conveyed by the transfer belt conveyor 33 into the opening formed by the film f, then the article 32 passes over the driving roller 35 and through the sealing device 37. Upon the passage of the article 32 through the sealing device 37, the sealing device 37 is actuated to weld the layers of the film f and to heat-cut the same to separate the packaged article from the film f. When the packaged article is separated from the film illustrated in FIG. 2. Accordingly, the first package is sealed on ly along the rear edges and the front edge of the same is not sealed. In the following operation, upon the arrival of an article 32 at the sealed edge 60, the film f containing the article 32 is delivered by means of the driving roller 36 and the pressure roller 35 through the sealing device 37, and then the rear edge of the package containing the article 32 is sealed to provide a sealed package 41 having sealed front and rear ends.

In this sealed package 41, the side edges of the film merely overlap each other. The overlapping portions of the film are welded in the succeeding heat tunnel 42 by heat-contraction to provide an airtight package. Since the underside of the package 41 is not welded, the package can be opened easily. It is also possible to provide a welding device for welding the underside of the package to weld the side edges of the film together by lap welding or butt welding.

Upon the detection of the arrival of the aticle 32 at the sealed edge 60 by means of a photoelectric detector 62, the driving roller 36 is actuated to deliver the film pinched between the driving roller 36 and the pressure roller 35 so that the article 32 is moved beyond the pressure roller 35 so that the article 32 is moved the sealing device 37. Accordingly, the film f is not fed until the article 32 arrives at the sealed edge 60. Upon the detection of the passage of the article 32 through the sealing device 37 by a photoelectric detector 63, the sealing device 37 is actuated.

Thus, the film f is not fed excessively and the sealing device does not operate uselessly even when the articles are fed at long intervals or even when the articles are fed at very short intervals as long as a slight space is provided between the successive articles. The articles are packaged properly and satisfactorily regardless of the longitudinal size thereof.

Since the article feeding belt coveyor 31 is operated at a low conveying speed, many articles can be stored on the article feeding conveyor 31. Since the transfer belt conveyor 33 is operated at a conyeing speed far greater than that of the article feeding belt conveyor 31, the article is tansported quickly to the sealed front edge of the film f, once the article is transferred from the article feeding belt conveyor to the transfer belt conveyor 33, and then the article is sealed in a package as soon as the same has passed through the sealing device 37. Accordingly, even if the articles are arranged at irregular intervals or at very small intervals on the article feeding belt conveyor 31, the preceding article is separated by far preferentially from the succeeding article by the transfer belt conveyor, and hence the operation of the sealing device 37 is unaffected by the manner of arrangement of the articles on the article feeding belt conveyor 31.

When the articles are changed for another articles having a different size, the film f is changed to another film having a different width suitable for packaging another articles and the lateral distance between the deflecting members of the forming device 34 is adjusted accordingly.

The packaging apparatus thus consturucted according to the present invention has the following prominent advantages and effects:

(1) The article is packaged by the film always with the side edges of the film correctly overlapping each other along a predetermined set line, and hence incomplete packaging is obviated and the package has satisfactory appearance;

(2) The film is pulled out by a necessary and appropriate length for every packaging cycle, therefore, the film is not consumed wastefully and the economy of the film is improved. Furthermore, fruits and vegetables varying in size between pieces can be packaged satisfactorily on the packaging apparatus regardless of the size. Still further, since articles need not be fed at regular intervals in time and space as far as the articles are spaced apart by the least necessary intervals, the packaging work is facilitated:

(3) Since the article is transported through the forimng device by a belt conveyor instead of feeding articles by arranging the articles continuously along a feeding passage and pushing the preceding article by the succeeding article, the forming devce is never clogged with the articles;

(4) Since the film is pulled out by the driving roller and the pressure roller according to the advancement of the article, even a light article can be satisfactorily and smoothly packaged regardless of the dead weight thereof. Furthermore, since the article packaged in the film need not be gripped vertically or laterally for pulling out the film, even fragile articles, such as fruits and vegetables, can be packaged without being damaged or spoiled; and (5) The packaging apparatus according to the present invention is very simple in construction and inexpensive as compared with the conventional packaging apparatus.

Although the invention has been described in its preferred form with a certain degree of particularity, it is to be understood that many changes and variations are possible in the invention without departing from the scope and spirit thereof.

What is claimed is:

1. A packaging apparatus for packaging articles in a weldable and heat-contractive plastic film, comprising:

a sealing device for welding and heat-cutting the plastic film widthwise;

a forming device disposed before the sealing device and having a pair of deflecting members disposed opposite to each other with a longitudinal space therebetween;

a guide bar disposed above the forming device with the longitudinal axis thereof in parallel to the longitudinal center axis of the forming device and with the contact line, where the plastic film leaves the guide bar, in alignment with the longitudinal center axis of the forming device;

a cantilever transfer belt conveyor for transferring articles from a feed belt conveyor to the sealing device, supported at the rear end so as to extend through the space between the deflecting members of the forming device;

a driving roller disposed between the front end of the transfer belt conveyor and the sealing device, to drive the plastic film from below; and a pressure roller disposed above the driving roller to press the plastic film against the driving roller, wherein the lower portions of the deflecting members are bent inward to form seaming flanges, the rear ends of the deflecting members are cut diagonally from the upper portions to the inner edges of the seaming flanges to form slopes declining toward the front, respectively, so that the plastic film folded in half is turned inside out along the respective outer surfaces of the deflecting members, and the sealing device is actuated upon the passage of an article through the sealing device.

2. A packaging apparatus according to claim 1, wherein the sealing device comprises an I-type sealing head having a central cutting blade and a pair of heat bars disposed on opposite sides of the central cutting blade to weld the portions of the film on opposite sides of the cutting line; a pressing block disposed below the sealing head to receive the sealing head thereon in welding and cutting the film, and pneumatic or hydraulic cylinders for driving the sealing head and the pressing block, respectively.

3. A packaging apparatus according to claim 1, wherein the arrival of the article at the front end of the plastic film and the passage of the article through the sealing device are detected by photoelectric means, the driving roller is actuated upon the detection of the arrival of the article at the front end of the plastic film, and the sealing device is actuated upon the detection of the passage of the article through the sealing device.

4. A packaging apparatus according to claim 1, wherein the plastic film is supplied from a roll of plastic film folded in half, and the plastic film is pulled out from the roll of plastic film as the driving roller drives the plastic film to pass the article through the sealing device.

5. A packaging apparatus according to claim 1, wherein the lateral distance between said deflecting members of the forming device is adjustable.

6. A packaging apparatus according to claim 1, wherein the position of the guide bar relative to the longitudinal center axis of the forming device is adjustable to adjust the seam line of the side edges overlapping each other on the underside of the article.

* * * * *